United States Patent [19]

Hayes

[11] 4,298,238

[45] Nov. 3, 1981

[54] MULTI-PIN ELECTRICAL PLUGS

[76] Inventor: Derek Hayes, Home Farm Cottage, St. Michael, Bungay, Suffolk NR35 1NF, Great Britain

[21] Appl. No.: 105,027

[22] Filed: Dec. 19, 1979

[30] Foreign Application Priority Data

Jan. 5, 1979 [GB] United Kingdom ..... 000405/79

[51] Int. Cl.[3] ..... H01R 13/508

[52] U.S. Cl. ..... 339/63 M; 339/196 M; 339/206 P

[58] Field of Search ..... 339/63, 196, 206 R, 339/206 P

[56] References Cited

U.S. PATENT DOCUMENTS

| | | | |
|---|---|---|---|
| 1,387,814 | 8/1921 | Bosch | 339/196 A |
| 3,308,421 | 3/1967 | White | 339/196 R |
| 3,519,980 | 7/1970 | Mosley | 339/196 R |
| 4,006,958 | 2/1977 | Kramer et al. | 339/196 A |

FOREIGN PATENT DOCUMENTS

| | | | |
|---|---|---|---|
| 217471 | 1/1958 | Australia | 339/196 R |

*Primary Examiner*—John McQuade

*Attorney, Agent, or Firm*—Howson and Howson

[57] ABSTRACT

A multi-pin electrical plug of the kind having a base with a first surface from which the current-carrying pins of the plug project, and a cover removably mounted on a second surface of the base, opposite the first surface, in a position of securement on the base. Interengaging means, for example cooperating tongues and grooves, are provided on the base and cover, by means of which the cover can be slid, in a direction substantially perpendicular to the axes of the pins of the plug, into its position of securement on the base. A movable locking means is incorporated in the plug for automatically locking the cover to the base, at least when the plug is inserted into a corresponding electrical socket with the cover in its position of securement on the base.

12 Claims, 7 Drawing Figures

MULTI-PIN ELECTRICAL PLUGS

Figure 1:
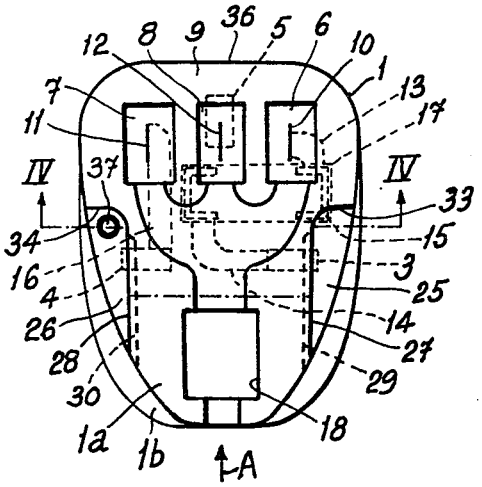

This invention relates to a multi-pin electrical plug, and in particular, but not exclusively, to a 3-pin, 13 amp electrical plug.

Hitherto known electrical plugs have a base from one face of which the contact pins project and a removable cover secured to the face of the base which is opposite to said one face, usually by one or more screws. It is a requirement that the cover should not be removable from the base when the plug is inserted into an electrical socket, and to this end the or each screw for holding the cover and the base together is insertable from the face of the base from which the contact pins project.

The present invention aims to provide a multi-pin electrical plug comprising a base with a removable cover, in which the cover is secured to the base without the need for screws and without the need to use a tool, and in which the cover cannot be removed from the base when the plug is fully inserted in a corresponding electrical socket.

According to the invention, a multi-pin electrical plug comprising a base from one surface of which the pins project and a cover removably mounted on a second surface of the base opposite to said one surface, is characterised in that the cover and base are provided with inter-engaging means, for example interengaging tongue and groove means, by means of which the cover can be slid in a direction substantially perpendicular to the axes of said pins into a position of securement on the base, and in that the cover and the base are provided with a movable locking means which, at least when the plug is inserted into a crossponding electrical socket with the cover in said position of securement on the base, automatically locks the cover to the base.

In a first embodiment of a plug in accordance with the invention, said locking means is provided with resilient means, for example spring means, which urges the locking means into a position in which it does not lock the cover to the base, and the locking means is arranged to lock the cover to the base, provided the cover is in said position of securement on the base, by the action of inserting the plug into a corresponding electrical socket. In this embodiment of the plug, the locking means may be in the form of a plunger slidably mounted in a bore passing through the base of the plug, the axis of the bore being substantially parallel to the axes of the pins of the plug. Normally, this plunger would be urged by the resilient means into a position in which a first end of the plunger projects from said one surface of the base, and the opposite end of the plunger is flush with, or slightly below, said second surface of the base, the cover then has a second bore which, when the cover is in said position of securement on the base, is aligned with the bore in the base so that it can receive said opposite end of the plunger when said first end of the plunger is pushed into the base by the action of inserting the plug into said electrical socket. In this first embodiment of the plug the bore in the base may be adjacent to a current-carrying pin of the plug in a position where said first end of the plunger acts as a shield to prevent a person accidentally touching the current-carrying pin when inserting the plug into, or withdrawing it from, said electrical socket.

In a second embodiment of the plug in accordance with the invention, the locking means is provided with resilient means, for example spring means, which urges the locking means into a position in which, provided the cover is in said position of securement on the base, it locks the cover to the base whether or not the plug is inserted into a corresponding electrical socket. Again, in this embodiment, the locking means may be in the form of a plunger slidably mounted in a bore passing through the base of the plug, the axis of the bore being substantially parallel to the axes of the pins of the plug. Normally, this plunger would be urged by the resilient means into a position in which a first end of the plunger is substantially flush with, or projects a short distance from, said one surface of the base, and the opposite end of the plunger projects from said second surface of the base. The cover then has a second bore which, when the cover is in said position of securement on the base, is aligned with the bore in the base so that it can receive said opposite end of the plunger. The cover may be adapted to depress said opposite end of the plunger out of its path as the cover is being slid into its position of securement on the base.

The plug may be provided with a snap-acting catch which holds the cover in its position of securement on the base.

Figure 4:
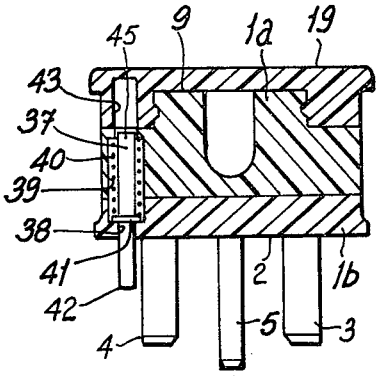
Figure 2:
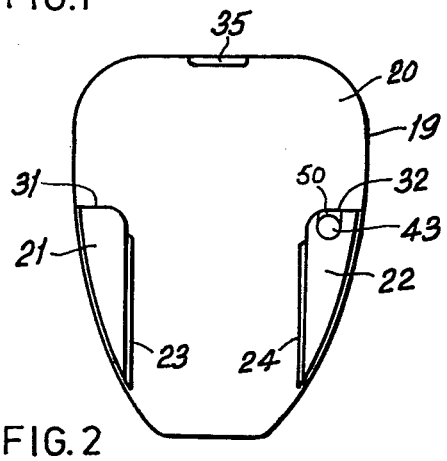
Figure 3:
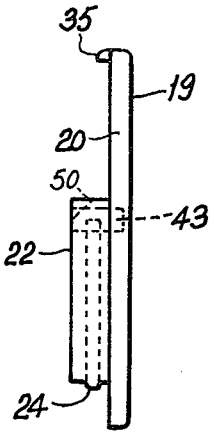
Figure 5:
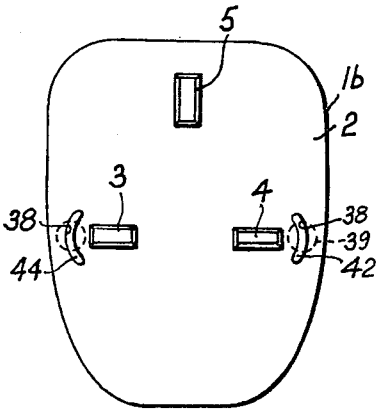

Embodiments of 3-pin, 13 amp plugs in accordance with the invention will now be described, by way of example, with reference to the accompanying drawing, in which FIG. 1 is a plan of the base of a first embodiment of the plug, FIG. 2 is an underside plan of the cover of this first embodiment of the plug, FIG. 3 is a side view of the cover shown in FIG. 2, FIG. 4 is a sectional view, taken on the line IV—IV of FIG. 1, of the base and cover assembled together, FIG. 5 is a view of the underside of the base of a first modified embodiment of the plug shown in FIGS. 1 to 4, and FIGS. 6 and 7 are partial sectional views, similar to FIG. 4, of second and third modified embodiments of the plug of FIGS. 1 to 4.

The plug shown in FIGS. 1 to 4 of the drawing comprises a base 1 having a first surface 2 from which the live, neutral and earth pins 3, 4 and 5, respectively, of the plug project. The plug is of the kind described in German lain-open patent application No. 26,45,143.4, published on Apr. 21, 1977, (hereinafter referred to as "the aforesaid specification"), and has recesses 6, 7 and 8 opening into a second surface 9 of the base for the reception of pairs of conductor-locating jaws (not shown) of the kind illustrated in, and described with reference to, FIGS. 7 and 8*a*–8*c* of the aforesaid specification. In the recesses 6, 7 and 8 there is a respective metallic, insulation-piercing means 10, 11 and 12 for piercing the electrical insulation of, and making electrical contact with, the conductors which are pressed into the recesses 6, 7 and 8 using the conductor-locating jaws, all as described fully in the aforesaid specification. The piercing means 10 is electrically connected to the pin 3 by metallic strips 13, 14 and a fuse holder 15, the piercing means 11 is electrically connected to the pin 4 by a metallic strip 16 and the piercing means 12 is electrically connected directly to the pin 5. The base 1 comprises upper and lower parts 1*a*, 1*b*, respectively, secured together with any suitable fastening means (not shown), e.g. screws or rivets, and the strips 13, 14 and 16 are conveniently located at the interface boundary between the parts 1*a*, 1*b*. The fuse holder 15 is conveniently sunk into a recess 17 in the surface 2 of the base 1.

A fourth recess 18 opening into the surface 9 of the base 1 serves to receive the jaws (not shown) of a cable grip.

A cover 19 is removably mountable on the base 1 to overlie the surface 9 of the latter. The cover 19 is made, like the base 1, of moulded plastics material and consists of a plate 20 of the underside of which are two spaced-apart projections 21, 22, moulded integrally therewith. Along the confronting surfaces of the projections 21, 22 are respective elongate tongues 23, 24 of trapezoidal cross-section, the two tongues being parallel to one another and parallel to, and spaced from, the lower surface of the plate 20. Formed in the surface 9 of the base 1 are two recesses 25, 26 of approximately the same shape as the projections 21, 22 of the cover, these recesses having respective outwardly-facing, parallel walls 27, 28. Grooves 29, 30 of trapezoidal cross-section are formed in the walls 27, 28, respectively, the two grooves being parallel to one another and parallel to the surface 9 of the base. The spacing apart of the projections 21, 22 of the cover 19, the spacing apart of the walls 27, 28 in the base 1 and the positions of the tongues 23, 24 and the grooves 29, 30 are chosen so that when the cover 19 is slid (in the direction of the arrow A) onto the base with the underside of the plate 20 of the cover bearing against the surface 9 of the base, the tongues 23, 24 of the cover enter and slide along the grooves 29, 30, respectively. This sliding movement of the cover on the base is limited by the walls 31, 32 of the projections 21, 22 abutting the walls 33, 34 of the recesses 25, 26 in the base. In this position of the cover, a lug 35 moulded on the plate 20 of the cover snaps over the end 36 of the base 1, to hold the cover on the base. This is the position of securement of the cover on the base, previously referred to.

A plunger 37 is slidably mounted in a hole 38 passing through the base from the surface 2 into the recess 26, the axis of this hole being parallel to the axes of the pins 3, 4 and 5. An intermediate portion 39 of the hole 38 is of larger diameter than the ends of the hole and this intermediate portion houses a helical spring 40 which surrounds the plunger 37 and bears against a collar 41 on the plunger to urge the latter to the position shown in FIG. 4 in which the lower end 42 of the plunger projects from the surface 2 of the base 1.

A hole 43 is formed in the cover 19 in a position such that, when the cover is in its position of securement on the base 1 with its lug 35 snapped over the end 36 of the base, the holes 38 and 43 are axially aligned.

When the plug, with the cover 19 in its position of securement on the base 1, is inserted into an electrical socket, the end 42 of the plunger is automatically pressed into the base, against the urging of the spring 40, and the upper end 45 of the plunger enters the hole 43. The cover is thus locked to the base and cannot be removed from the base while the lug remains fully inserted in the electrical socket or even partially withdrawn from the socket.

In the embodiment of the plug illustrated, the hole 43 in the cover 19 is a blind hole. In a modified embodiment, the hole 43 passes right through the cover. In this embodiment, a longer plunger 37 can be employed, which normally projects from the surface 2 of the base as far as the pins 3 and 4. This means that the pins 3 and 4 have to be withdrawn completely from a socket into which the plug is inserted before the cover 19 can be removed from the base. Furthermore, when the plug is fully inserted into a socket, the end 45 of the plunger 37 will project from the cover 19. This gives an indication of whether the plug has been fully inserted into the socket, which is advantageous in some instances. For example, the projection of the plunger can be felt by a blind person or when the plug is being inserted in a socket which is hidden from view.

FIG. 5 shows a modified embodiment of the plug of FIGS. 1 to 4 in which at least the end 42 of the plunger 37 is of flattened cross-section instead of circular cross-section as in FIGS. 1 to 4. Furthermore the bore 38 in the base part **1*b* has a similar flattened cross-section where it opens into the surface 2 of the base, which bore opens out into the bore 39. In this embodiment, the bore 38 is located closer to the pin 4 than in the embodiment of FIGS. 1 to 4, in a position where it can act as a shield to prevent a person accidentally touching the pin 4 when inserting the pin into, or withdrawing it from, an electrical socket. The pin 3 of the plug may be provided with a similar shield 44 which may be the lower end of a second plunger serving the same purpose as the plunger 37 for locking the cover of the plug to the base 1. A second hole, similar to the hole 43 (FIG. 2) would then be provided in the projection 21** of the cover to receive the upper end of the second plunger when the plug is inserted into an electrical socket.

Figure 6:
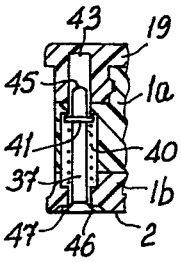

FIG. 6 shows another modified form of the plug of FIGS. 1 to 4 in which the collar 41 on the plunger 37 is differently positioned compared with the plug of FIGS. 1 to 4, so that the spring 40 normally urges the plunger 37 into the hole 43 in the cover 19. In this embodiment, the end 45 of the plunger will project from the base portion **1*a* when the cover 19 is removed from the base. In order to prevent the projecting plunger end 45 from stopping the cover being slid into its position of securement on the base, the end 45 must be pushed down into the base portion 1*a*. This can be done manually or alternatively the projection 22 (see FIG. 2) on the cover 19 may be provided with a slot 50, the bottom of which is inclined as shown in FIG. 3, which acts as a camming surface to depress the plunger end 45 automatically when the cover 19 is slid into its position of securement on the base. The tip of the end 45 may be rounded to facilitate this camming action. The lower end of the plunger 37 may be provided with an enlarged head 46 in a recess 47 in the surface 2 of the base to facilitate withdrawal of the end 45 of the plunger 37 from the hole 43** in the cover, using a suitable tool, for example a narrow bladed screw-driver, when it is desired to remove the cover from its position of securement on the base.

Figure 7:
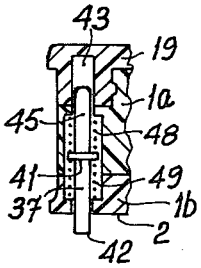

FIG. 7 shows a modified form of the plug of FIG. 6, in which again the collar 41 of the plunger 37 is differently positioned compared with the plug of FIGS. 1 to 4, and two springs 48, 49 are provided instead of the spring 40. In this case the springs 48, 49 urge the plunger 37 into a position in which its lower end 42 projects a short distance from the base part **1*b* and its upper end 45 projects a short distance from the base part 1*a*, into the hole 43 in the cover 19. When the plug is inserted into an electrical socket, the end 42 of the plunger is pushed into the base part 1*a* and the end 45 penetrates more deeply into the hole 43. When the plug is removed from the socket, the plunger 37 resumes the position shown in FIG. 7, and the lower end 42 of the plunger can be pulled manually further from the base part 1*b* to release the end 45 from the hole 43 in the cover, thus allowing removal of the latter from the plug base. When it is desired to replace the cover 19 on the plug base, the lower end 42 of the plunger may again be pulled out manually further from the base part 1***b*, or alternatively the cover 19 may be provided with the slot 50 described above with reference to FIG. 6 for the purpose of depressing the plunger end 45 automatically when the cover is slid into its position of securement on the base.

The invention is not, of course, limited to the particular embodiments of the plug described above with reference to the drawing. Thus, for example, in an alternative embodiment, the tongues 23, 24 are provided on the base 1 and the grooves 29, 30 are provided in the projections 21, 22 of the cover. Furthermore, the tongues and grooves need not be of trapezoidal cross-section. Again, forms of interengaging means other than tongues and grooves may be employed for securing the base and cover together. For example, the cover 19 may be of channel section, with the webs of the channel arranged to embrace the sides of the base 1. Each web could then have an inwardly-projecting flange at its free end to bear against the surface 2 of the base.

Although the invention has been described in detail above with reference to a 3-pin, 13 amp plug, it will be understood that the invention is applicable to other multi-pin plugs.

What is claimed is:

1. A multi-pin electrical plug comprising a base having one surface from which the pins project, a cover removably mounted on a second surface of the base opposite to said one surface, interengaging means on the cover and the base by means of which the cover can be slid in a direction substantially perpendicular to the axes of said pins into a position of securement on the base, movable locking means for automatically locking said cover to the base, and resilient means which urges the locking means into a position in which, provided the cover is in said position of securement on the base, it locks the cover to the base whether or not the plug is inserted into a corresponding electrical socket.

2. An electrical plug according to claim 1, in which said locking means comprises a plunger slidably mounted in a first bore passing through the base of the plug, the axis of said first bore being substantially parallel to the axes of said pins.

3. An electrical plug according to claim 2, in which said plunger is urged by said resilient means into a position in which a first end of the plunger is substantially flush with, or projects a short distance from, said one surface of the base, and the opposite end of the plunger projects a short distance from said second surface of the base, and said cover has a second bore which, when the cover is in said position of securement on the base, is aligned with said first bore so that it can receive said opposite end of the plunger.

4. An electrical plug according to claim 3, comprising means on said cover for depressing said opposite end of the plunger out of its path as the cover is being slid into its position of securement on the base.

5. An electrical plug according to claim 1, in which the interengaging means provided on the cover and base comprises interengaging tongue and groove means.

6. An electrical plug according to claim 1, comprising a snap-acting catch for retaining the cover in its position of securement on the base.

7. A multi-pin electrical plug comprising a base having one surface from which the pins project, a cover removably mounted on a second surface of the base opposite to said one surface, interengaging means on the cover and the base by means of which the cover can be slid in a direction substantially perpendicular to the axes of said pins into a position of securement on the base, and movable locking means for automatically locking said cover to the base at least when the plug is inserted into a corresponding electrical socket with the cover in said position of securement on the base, in which the locking means is provided with resilient means which urges the locking means into a position in which it does not lock the cover to the base, and the locking means is arranged to lock the cover to the base, provided the cover is in said position of securement on the base, by the action of inserting the plug into a corresponding electrical socket.

8. An electrical plug according to claim 7 in which said locking means comprises a plunger slidably mounted in a first bore passing through the base of the plug, the axis of said first bore being substantially parallel to the axes of said pins.

9. An electrical plug according to claim 8, in which said plunger is urged by said resilient means into a position in which a first end of the plunger projects from said one surface of the base, and the opposite end of the plunger is flush with, or slightly below, said second surface of the base, and said cover has a second bore which, when the cover is in said position of securement on the base, is aligned with said first bore in the base so that it can receive said opposite end of the plunger when said first end of the plunger is pushed into the base by the action of inserting the plug into a corresponding electrical socket.

10. An electrical plug according to claim 9, in which said first bore is adjacent to a current-carrying pin of the plug in a position where said first end of the plunger acts as a shield to prevent a person accidentally touching the current-carrying pin when inserting the plug into, or withdrawing it from, said electrical socket.

11. An electrical plug according to claim 10, in which said locking means comprises a second plunger slidably mounted in a third bore passing through the base of the plug and arranged to cooperate with a fourth bore in the cover in the same way as the first mentioned plunger cooperates with said second bore in the cover, said third bore being adjacent to a second current-carrying pin of the plug in a position where the first end of the second plunger acts as a shield to prevent a person accidentally touching the second current-carrying pin when inserting the plug into, or withdrawing it from, said electrical socket.

12. A multi-pin electrical plug comprising a base having one surface from which the pins projects, a cover removably mounted on a second surface of the base opposite to said one surface, interengaging means on the cover and the base by means of which the cover can be slid in a direction substantially perpendicular to the axes of said pins into a position of securement on the base, movable locking means for automatically locking said cover to the base, and resilient means which urges the locking means into a position in which, provided the cover is in said position of securement on the base, it locks the cover to the base whether or not the plug is inserted into a corresponding electrical socket, in which said locking means comprises a plunger slidably mounted in a first bore passing through the base of the plug, the axis of said first bore being substantially parallel to the axes of said pins, in which said plunger is urged by said resilient means into a position in which a first end of the plunger is substantially flush with, or projects a short distance from, said one surface of the base, and the opposite end of the plunger projects a short distance from said second surface of the base, and said cover has a second bore which, when the cover is in said position of securement on the base, is aligned with said first bore so that it can receive said opposite end of the plunger, and in which said first bore is adjacent to a current-carrying pin of the plug in a position where said first end of the plunger acts as a shield to prevent a person accidentally touching the current-carrying pin when inserting the plug into, or withdrawing it from, said electrical socket.

* * * * *